US005669272A

United States Patent [19]

Hansen

[11] Patent Number: 5,669,272

[45] Date of Patent: Sep. 23, 1997

[54] OPEN END RATCHET WRENCH

[75] Inventor: William S. Hansen, New Berlin, Wis.

[73] Assignee: A&E Manufacturing Company, Racine, Wis.

[21] Appl. No.: 605,395

[22] Filed: Feb. 22, 1996

[51] Int. Cl.[6] ..... B25B 13/12

[52] U.S. Cl. ..... 81/179; 81/90.1

[58] Field of Search ..... 81/58.2, 90.1, 81/179

[56] References Cited

U.S. PATENT DOCUMENTS

| | | | |
|---|---|---|---|
| 2,712,259 | 7/1955 | Cowell | 81/179 |
| 2,983,173 | 5/1961 | Buxton | 81/179 |
| 3,165,015 | 1/1965 | Hinrichs | 81/179 |
| 3,921,474 | 11/1975 | Dyck et al. | 81/91 B |
| 3,927,582 | 12/1975 | Hertelendy et al. | 81/58.2 |
| 4,204,440 | 5/1980 | Del Prete et al. | 81/111 |
| 4,488,459 | 12/1984 | Bailey et al. | 81/58.2 |
| 4,574,665 | 3/1986 | Blachly | 81/59.1 |
| 4,644,830 | 2/1987 | Bailey et al. | 81/58.2 |
| 4,718,315 | 1/1988 | Nitschmann | 81/58.2 |
| 4,926,720 | 5/1990 | Srzanna | 81/61 |
| 5,456,143 | 10/1995 | Stanton | 81/179 |
| 5,553,520 | 9/1996 | Jacobs | 81/179 X |

FOREIGN PATENT DOCUMENTS 568058 6/1923 France .

*Primary Examiner*—James G. Smith

*Attorney, Agent, or Firm*—Andrus, Sceales, Starke & Sawall

[57] ABSTRACT

A ratchet wrench comprises a body disposed on a handle, the body having a head provided with a main wall defining an opening for receiving an element to be rotated. A pair of supplementary walls extends radially outwardly from the main wall, each of the supplementary walls being formed with a plurality of variously-shaped segments defining a recess. A pair of element engaging jaw members are retained in each of the recesses, each of the jaw members having a multiplicity of variously-shaped surfaces slidable and pivotable along the segments of each of the recesses. A pair of springs cooperates with the jaw members, each of the springs being mounted separately in each of the recesses for biasing each of the jaw members into the opening. Rotation of the wrench in one direction maintains a bias of the spring such that when the element to be rotated is engaged against each of the jaw members, the element is driving the rotating. Rotation of the wrench in an opposite direction acts against the bias of the spring to move each of the jaw members such that the element to be rotated slips against each of the jaw members to permit the element to ratchet.

20 Claims, 2 Drawing Sheets

FIG. 1
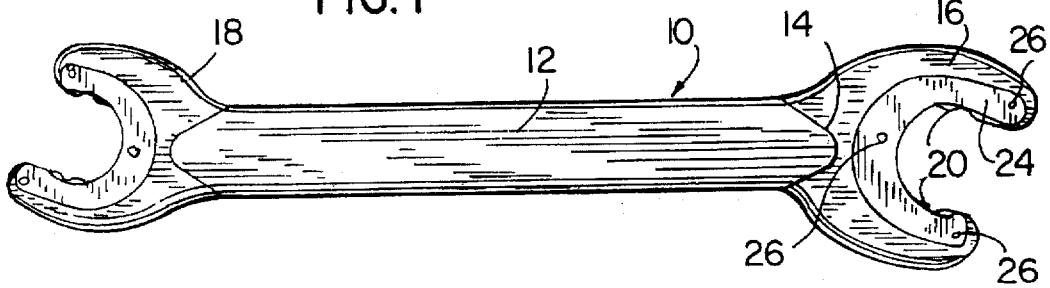
FIG. 2
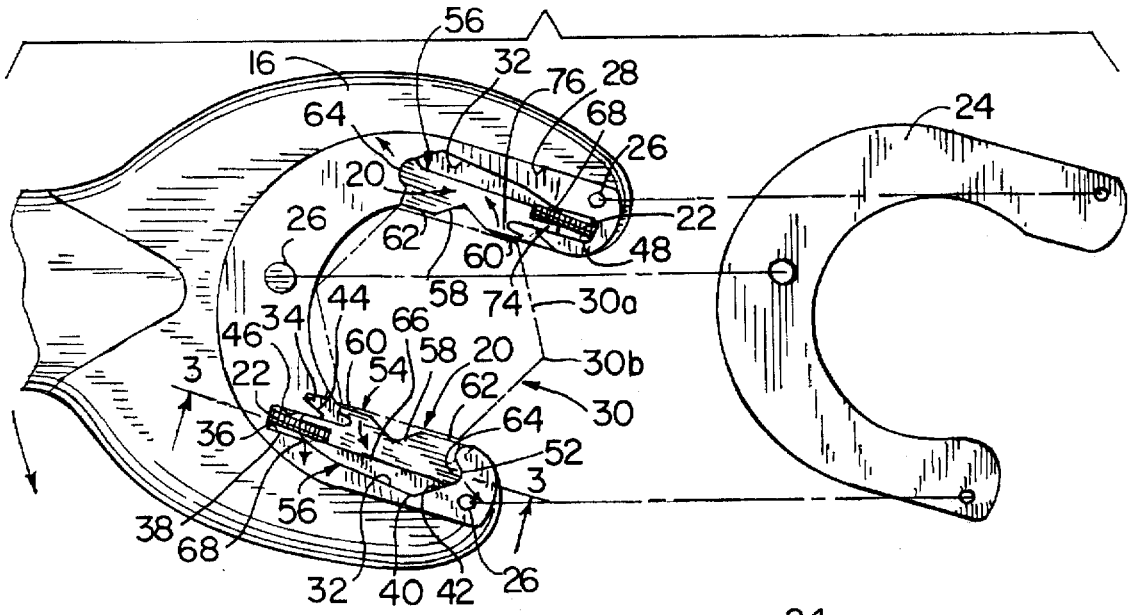
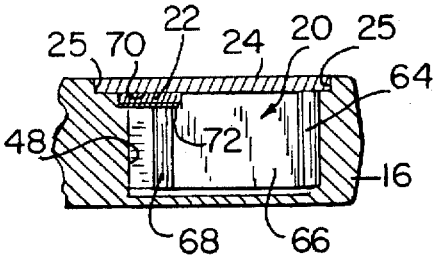
FIG. 3
FIG. 4
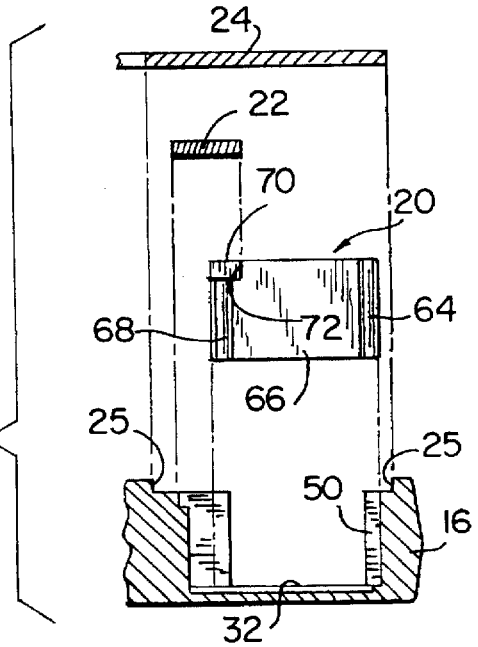

FIG. 5
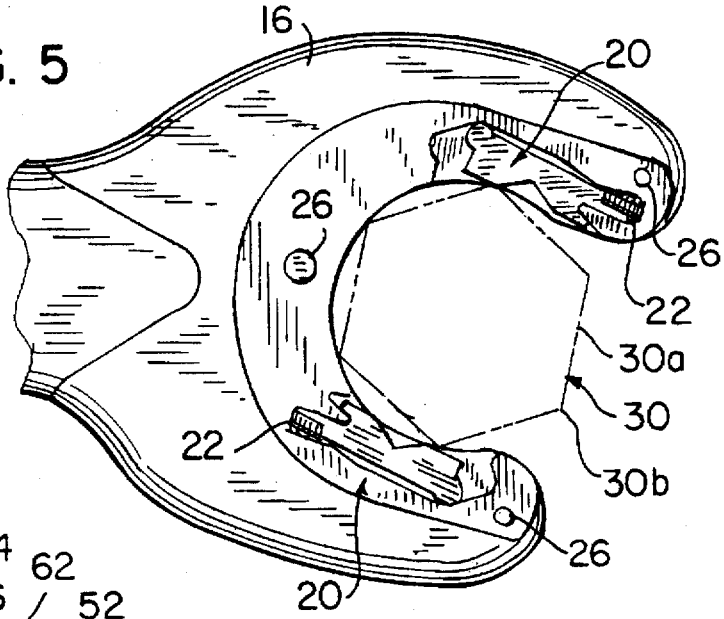
FIG. 6
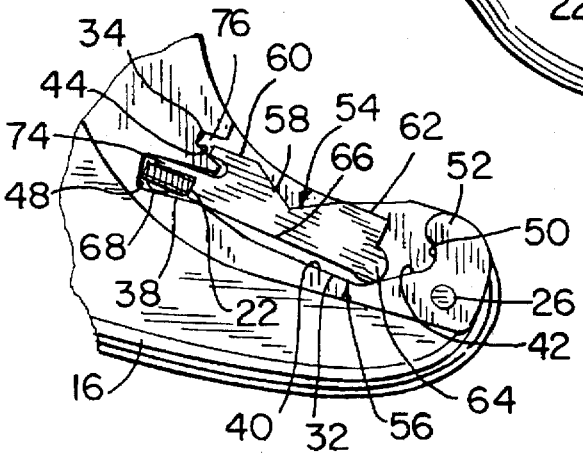
FIG. 7
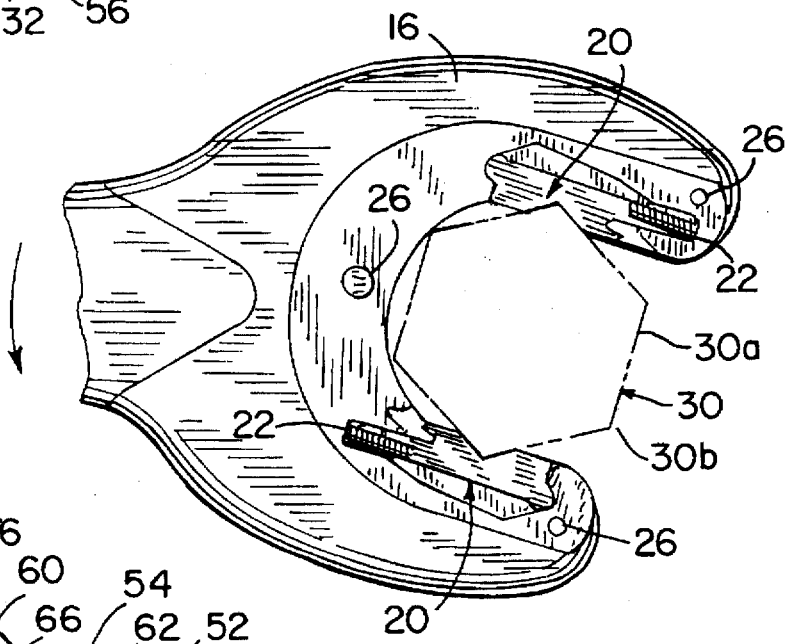
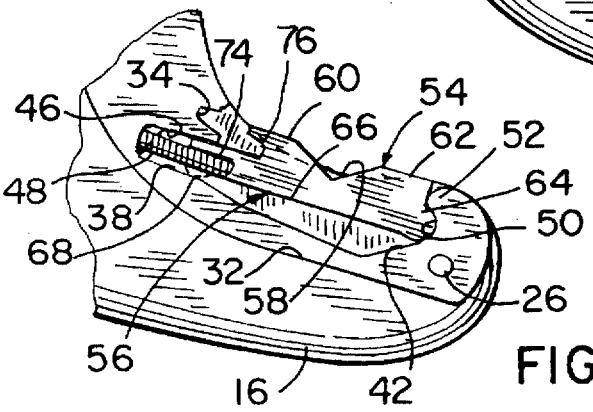
FIG. 8

OPEN END RATCHET WRENCH

FIELD OF THE INVENTION

The invention relates broadly to a hand tool, and more particularly, pertains to an open end ratchet wrench mountable on a fastener head in self-securing relationship therewith.

BACKGROUND OF THE INVENTION

Open end ratchet wrenches are widely used by aircraft mechanics, automotive engineers, plumbers and other maintenance personnel in tightening and loosening rotatable fastener elements, such as nuts, bolts, tubing and fittings, which are difficult to access due to the small space in which they are sometimes installed. Such ratchet wrenches generally include biased, movable jaw members, pawls, cams or the like arranged to securely grip the fastener element when moved in a torquing direction, and selectively slip, or ratchet, the fastener element when moved in an opposite direction.

Although there are many different mechanical ratcheting arrangements employed in today's hand tools, there remains a need for an improved ratchet wrench which optimizes torque transmission and reduces contact stresses so as to ensure the integrity of the wrench and the fastener element.

SUMMARY OF THE INVENTION

The ratchet wrench of the present invention advantageously provides an effective ratcheting motion achieved by the unique shape of the jaw members interacting against complimentary walls formed in the wrench body. A sliding pivot principle allows for the most efficient motion of the jaw member to optimize jaw and wrench body space constraints. A coil spring cooperates with each jaw member to allow the jaw member to reset upon a fastener element at 30° increments of the wrench body rotation. The wrench provided by the present invention is extremely durable and relatively easy to manufacture owing to its small number of components.

In one aspect of the invention, a ratchet wrench comprises a handle, and a body disposed on the handle, the body having a head provided with a main wall defining an opening for receiving an element to be rotated. A pair of supplementary walls extends radially from the main wall, each of the supplementary walls being formed of a plurality of variously-shaped segments defining a recess. A pair of element engaging jaw members are retained in each of the recesses, each of the jaw members having a plurality of variously-shaped surfaces which are slidable and pivotable along segments of each of the recesses. A pair of springs interact with the jaw members, each of the springs being mounted separately in each of the recesses for biasing each of the jaw members into the opening. Rotation of the wrench in one direction maintains a bias of the spring such that when the element to be rotated is engaged against each of the jaw members, the element is drivingly rotated. Rotation of the wrench in the opposite direction acts against the bias of the spring .to move each of the jaw members such that the element to be rotated slips against each of the jaw members to permit the element to ratchet.

In another aspect of the invention, a ratchet wrench has a handle, a body having an opening formed therein for receiving an element to be rotated, a set of recesses extending radially outwardly from the opening and a set of element engaging jaw members retained in the recesses for engagement with the element to be rotated and projectable into the opening. The improvement resides in each of the recesses including a ramp segment having a mouth, and a linear segment opposite the ramp segment. Each of the jaw members are rigid and have a dimpled end portion slidable against the ramp segment, and a nosed end portion opposite the dimpled end portion which is slidable and pivotable against the linear segment. A spring is positioned in each of the recesses and is engageable with the nosed end portion to normally force the dimpled end portion into the mouth and facilitate retention of each of the jaw members in each of the recesses.

In yet another aspect of the invention, a ratchet wrench for driving and ratcheting an element to be rotated comprises a handle and a body connected with the handle and including a substantially C-shaped head having a main wall defining a substantially C-shaped opening therein for receiving the element to be rotated. The body also includes a set of supplementary walls, each of the supplementary walls extending radially outwardly of the opening defining a respective recess therein. Each of the supplementary walls includes a ramp segment having a mouth, and a linear segment opposite the ramp segment. A set of movable jaw members is retained in each of the recesses, each of the jaw members having an innermost surface projecting into the opening and engageable with the element to be rotated, and an outermost surface joined to the innermost surface and including a dimpled end portion and a nosed end portion opposite the dimpled end portion. The dimpled end portion is slidable against the ramp segment and into and out of the mouth of the supplementary wall, and the nosed end portion is slidable and pivotable against the linear segment of the supplementary wall. A spring arrangement is positioned in each of the recesses and is engageable with each of the nosed end portions of the jaw members to facilitate retention of each of the jaw members in the recesses.

In yet another aspect of the invention, a ratchet wrench for driving and ratcheting a nut comprises an elongated handle and a body connected with the handle and including a substantially C-shaped head having a main wall defining a substantially C-shaped opening therein for receiving the nut. A pair of supplementary walls extends radially outwardly of the opening defining a respective recess therein, each of the supplementary walls including a ramp segment having a mouth, a linear segment opposite the ramp segment, and an intermediate segment joining the ramp segment and the linear segment. A pair of rigid, movable jaw members are retained in the recesses, each of the jaw members having an innermost surface projectable into the opening and engageable with the nut. The innermost surface comprises a V-shaped notch having flat faces on each side thereof. Each of the jaw members also has an outermost surface joined to the innermost surface and includes a dimpled end portion and a nosed end portion opposite the dimpled end portion. The dimpled end portion is slidable against the ramp into and out of the mouth of the supplementary wall. The nosed end portion is slidable and pivotable against the linear segment of the supplementary wall. A coil spring is positioned in each of the recesses and is engageable with the nosed end portion to normally bias the dimpled end portion within the mouth. A cover is connected to the head to facilitate retention of each of the jaw members and each of the springs with recesses. Rotation of the wrench in one direction maintains the bias of the coil spring on the nosed end portion, and forces the dimpled end portion into the mouth so that when the nut is engaged against the innermost surface of the jaw member, the nut is drivingly rotated. Rotation of the wrench in an opposite direction acts against the innermost surface of the jaw member and against the bias of the coil spring to move the dimpled end portion out of the mouth along the ramp segment and causes the nosed portion to pivot and slide along the linear segment so that the nut will slip along the innermost surface of the jaw member to permit the nut to ratchet.

Other objects and advantages will appear in the course of the following description.

BRIEF DESCRIPTION OF THE DRAWINGS

The drawings illustrate the best mode presently contemplated of carrying out the invention of the drawings.

FIG. 1 is a plan view of a ratchet wrench embodying the present invention;

FIG. 2 is an enlarged, fragmentary, exploded view of the ratcheting mechanism employed in the present invention;

FIG. 3 is a partial, sectional view taken on line 3—3 of FIG. 2;

FIG. 4 is an exploded view of the components shown in FIG. 3;

FIG. 5 is an enlarged, fragmentary view of the ratcheting mechanism of FIG. 2 showing the nut being advanced 30°;

FIG. 6 is an enlarged, fragmentary view of the jaw member and its complimentary recess shown in FIG. 5;

FIG. 7 is an enlarged, fragmentary view of the ratcheting mechanism of FIG. 5 showing the nut having been advanced 30°; and FIG. 8 is an enlarged, fragmentary view of the jaw member and its complimentary recess shown in FIG. 7.

DETAILED DESCRIPTION OF THE PREFERRED EMBODIMENT

Referring to FIG. 1, a ratchet wrench 10 comprises an elongated handle 12 integrally formed, at least at one end, with a cast body 14 having a substantially C-shaped head 16, and in the illustrated embodiment, comprising a double head wrench having at its opposite end a similar head 18. Each of the heads 16, 18 are respectively designed to operate on different sized elements to be torqued. Other than that, the heads 16, 18 are substantially identical to each other and the following description of one will apply to the other. For example, wrench head 16 may be adapted for torquing a hexagonal bolt head or nut of ⅝ inch dimension while the wrench head 18 may be adapted to torque a similar element of ¾ inch dimension. Such dimensions are illustrative only, and it will be appreciated that if desirable, a set of graduated wrench head sizes may be offered.

As seen in FIG. 2, the head 16 is suitably recessed to accommodate a pair of identical, rigid, movable jaw members 20 and a pair of coil springs 22, both of which are retained in the head 16 by a thin, C-shaped cover plate 24 having a shape and size corresponding to that of its respective head 16. In assembled form, each cover plate 24 is placed in overlapping relationship to its respective head 16 and is securely attached by a set of rivets 26 thereto.

The head 16 is provided with a main wall 28 defining a substantially C-shaped central opening for receiving a multi-faced element 30, such as a hex head nut, adapted to be torqued, for example, onto a suitably threaded bolt. A pair of identical, supplemental walls 32 extend radially outwardly of the opening 28, each of the supplementary walls 32 being formed of a plurality of variously-shaped interconnected segments which jointly define a recess for individually housing one of the jaw members 20 and one of the coil springs 22 therein.

In a unique design, each supplementary wall 32 includes an angled cavity 34, a substantially horizontally disposed slot 36 (including a linear segment 38) flowing from the cavity 34, an intermediate segment 40, and an upwardly extending ramp segment 42 located opposite the slot 36. Cavity 34 has an angled underside 44 which merges with the top wall 46 of the slot 36 thereby forming a guide surface for each jaw member 20 as will be appreciated hereafter. Top wall 46 extends downwardly into a short back wall 48 which turns and develops into a bottom wall defined by the linear segment 38. The intermediate segment 40 is downwardly directed and connects the linear segment 38 with the upwardly extending, ramp segment 42 which is provided with a mouth 50 and terminates in a lip 52.

Each jaw member 20 is formed of one piece with a multiplicity of variously-shaped surfaces including a nut-engaging innermost surface 54 joined to an outermost surface 56, portions of which interact with supplementary wall 32 defining a recess. Innermost surface 54 includes a V-shaped wall 58 defining a notch, and a pair of flat faces 60, 62 located on either side thereof. Outermost surface 56 includes a dimpled end portion 64, a substantially straight back surface 66 and a nosed end portion 68 opposite the dimpled end portion 64. Dimpled end portion 64 is normally disposed in the mouth 50 of ramp segment 42 yet is slidable with respect thereto, while nosed end portion 68 is both slidable and pivotable along the linear segment 38. Nosed end portion 68 also includes a horizontal groove 70 having a stop wall 72 and an elongated finger 74 which is adapted to slide along the top wall 46 of the slot 36. A projection 76 extending from an outer end of flat face 60 is slidable into and out of the angled cavity 34.

The wrench 10 includes an arrangement for normally biasing the jaw members 20 into the mouth 50 of ramp segment 42 so that the wrench can be torqued. This biasing action is accomplished by the small diameter coil spring 22 having one end thrust against the back wall 48 of slot 36 and the other end displaced against the stop wall 72 of horizontal groove 70 and jaw member 20. When assembling the components, the spring 22 is placed under sufficient compression to normally bias the jaw member 20 into the mouth 50 on ramp segment 42. However, the spring 22 is of sufficiently movable coil structure to allow a range of compression to provide a substantial riding movement of the jaw member 20 away from the ramp segment 42 as seen in the difference between FIG. 8 and FIG. 6.

The cover plate 24 is designed to fit into recessed portions 25 of the head 16 (FIG. 4) so as to guide and maintain the one piece jaw member 20 within the recess and to avoid any interference with the element, such as the nut 30, to be torqued.

Referring now to FIG. 2, the nut 30 to be torqued is received in the recess with the jaw member faces 60, 62 engaging corresponding flat sides **30*a* of the nut 30. (Although not shown, the nut 30 may also be accommodated in the recess with the jaw member notches 58 surrounding opposed apexes 30*b* of the nut 30.) By swinging the tool 10 in the direction opposite the arrow shown in FIG. 2, that is clockwise, a firm torquing grip is placed on the nut 30 and torque is applied to the degree desired or allowed by the installation space. Then, in order to engage succeeding surfaces of the nut, reverse turning of the tool 10, as indicated by the arrow in FIG. 5, effects release and regripping of the nut 30. As the wrench is turned in the counterclockwise direction shown in FIG. 5, the apex 30*b* of nut 30 engages the flat face 60, 62 of each jaw member 20 slidably pushing each dimpled end portion 64 out of the respective mouth 50 and along respective ramp segment 42. During this movement, elongated finger 74 slides along the top wall 46 of slot 36 and projection 76 moves along the angled underside 44 of cavity 34. As best seen in FIG. 6, each coil spring 22 is compressed between back wall 48 of slot 36 and stop wall 72 on jaw member 20. To facilitate a particularly smooth transition, nosed end portion 68 not only slides along linear segment 38 of the slot 36, but also slightly pivots therealong so that the innermost surface 54 of jaw member 20 is retracted from out of the opening 28. At this point, full release of the previously gripped surfaces of the nut 30 occurs, and the jaw member 20 moves sequentially towards a gripping position 30° advanced as shown in FIGS. 7 and 8, wherein the apexes 30*b* of the nut 30 fall into respective notches of the jaw members 20. The torquing maneuver can then be repeated because such biasing spring 22 returns each jaw member 22 to a torquing position in the wrench head 16. Alternatively, a further ratcheting movement can be obtained, as indicated by the arrow in FIG. 7**, in the same fashion as described above.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A ratchet wrench comprising:

a handle;

a body disposed on said handle, and having a head provided with a main wall defining an opening for receiving an element to be rotated;

a pair of supplementary walls extending radially outwardly from said main wall, each of said supplementary walls being formed of a plurality of variously-shaped segments defining a recess;

a pair of element engaging jaw members retained in each of said recesses, each of said jaw members having a multiplicity of variously-shaped surfaces slidable and pivotable along said segments of each of said recesses, each of said jaw members including a first rounded end portion slidable along a first portion of one of said supplementary walls and a second rounded end portion opposite said first rounded end portion and slidable and pivotable along a second portion of one of said supplementary walls; and a pair of springs, each of said springs being mounted separately in each of said recesses for biasing each of said jaw members into said opening, whereby rotation of said wrench in one direction maintains a bias of said spring such that when the element to be rotated is engaged against each of said jaw members, the element is drivingly rotated; and whereby rotation of the wrench in an opposite direction acts against the bias of the spring to move each of said jaw members such that the element to be rotated slips against each of the said jaw members to permit the element to ratchet.

2. The wrench of claim 1, wherein each of said supplementary walls includes a ramp segment having a mouth, and a linear segment opposite said ramp segment.

3. The wrench of claim 2, wherein each of said jaw members includes an innermost surface comprising a single V-shaped notch having flat faces extending from each side thereof.

4. The wrench of claim 1, including a cover connected to said head to facilitate retention of each of said jaw members and each of said springs in each of said recesses.

5. In a ratchet wrench having a handle, a body having an opening formed therein for receiving an element to be rotated, a set of recesses extending radially outwardly from said opening and a set of element engaging jaw members retained in said recesses for engagement with an element to be rotated and projectable into said opening, the improvement residing in:

each of said recesses including a ramp segment terminating in a mouth, and a linear segment opposite said ramp segment;

each of said jaw members being rigid and having a dimpled end portion slidable against said ramp segment, and a nosed end portion opposite said dimpled end portion, said nosed end portion being slidable and pivotable against said linear segment; and a spring positioned in each of said recesses and engageable with said nosed end portion to normally force said dimpled end portion into said mouth and facilitate retention of each of said jaw members in each of said recesses.

6. The improvement of claim 5, wherein each of said recesses includes a slot formed therein, said slot having a bottom wall defined by said linear segment, a top wall and a back wall joining said bottom wall and said top wall.

7. The improvement of claim 6, wherein said nosed end portion includes a recessed stop wall, and an elongated finger extending from said stop wall and slidable along said top wall of said slot.

8. The improvement of claim 7, wherein said spring has one coiled end engageable against said back wall of said slot and another coiled end engageable against said stop wall on each of said jaw members.

9. The improvement of claim 5, wherein each of said recesses also includes an angled cavity.

10. The improvement of claim 9, wherein each of said jaw members further includes a projection slidable into and out of said angled cavity.

11. The improvement of claim 10, wherein each of said jaw members has an element engaging surface comprising a V-shaped notch and a pair of flat faces lying on each side of said notch.

12. The improvement of claim 11, wherein one of said flat faces forms an upper portion of said projection.

13. The improvement of claim 5, wherein each of said jaw members is retractable from said opening enabling said element to be rotated to ratchet in said opening.

14. A ratchet wrench for driving and ratcheting an element to be rotated, said wrench comprising:

a handle;

a body connected with said handle and including a substantially C-shaped head having a main wall defining a substantially C-shaped opening therein for receiving said element to be rotated and a set of supplementary walls, each of said supplementary walls extending radially outwardly of said opening defining a respective recess therein, each of said supplementary walls including a ramp segment terminating in a mouth and a linear segment opposite said ramp segment;

a set of movable jaw members, each of said jaw members being retained in each of said recesses and having an innermost surface projecting into said opening and engageable with the element to be rotated, and an outermost surface joined to said innermost surface and including a dimpled end portion and a nosed end portion opposite said dimpled end portion, said dimpled end portion being slidable against said ramp segment and into and out of said mouth of said supplementary wall and said nosed end portion being slidable and pivotable against said linear segment of said supplementary wall; and a spring arrangement positioned in each of said recesses and engageable with each of said nosed end portions of said jaw members to facilitate retention of each of said jaw members in said recesses.

15. The wrench of claim 14, wherein each of said supplementary walls includes a slot formed therein, said slot having a bottom wall defined by said linear segment, a top wall, and a back wall joined to said bottom wall and said top wall.

16. The wrench of claim 15, wherein each of said jaw members includes a recessed stop wall and an elongated finger extending from said stop wall and being slidable along said top wall of said slot.

17. The wrench of claim 16, wherein said spring arrangement comprises a coiled spring having one end engageable against said back wall of said slot, and another end engageable against said stop wall of each of said jaw members.

18. A ratchet wrench for driving and ratcheting a nut, said wrench comprising:

an elongated handle;

a body connected with said handle and including a substantially C-shaped head having a main wall defining a substantially C-shaped opening therein for receiving said nut, and a pair of supplementary walls, each of said supplementary walls extending radially outwardly of said opening defining a respective recess therein, each of said supplementary walls including a ramp segment terminating in a mouth, a linear segment opposite said ramp segment, and an intermediate segment joining said ramp segment and said linear segment;

a pair of rigid, movable jaw members retained in said recesses, each of said jaw members having an innermost surface projectable into said opening and engageable with said nut, each innermost surface comprising a V-shaped notch having flat faces on each side thereof, each of said jaw members also having an outermost surface joined to said innermost surface and including a dimpled end portion and a nosed end portion opposite said dimpled end portion, said dimpled end portion being slidable against said ramp segment and into and out of said mouth of said supplementary wall, and said nosed end portion being slidable and pivotable against said linear segment of said supplementary wall;

a coil spring positioned in each of said recesses and engageable with said nosed end portion to normally bias said dimpled end portion within said mouth; and a cover connected to said head to facilitate retention of each of said jaw members and each of said springs within each of said recesses, whereby rotation of the wrench in one direction maintains the bias of said coil spring on said nosed end portion and forces said dimpled end portion into said mouth so that when said nut is engaged against said innermost surface of said jaw member, said nut is drivingly rotated; and whereby rotation of the wrench in an opposite direction from said one direction acts against said innermost surface of said jaw member and against the bias of said coil spring to move said dimpled end portion out of said mouth along said ramp segment and causes said nosed portion to pivot and slide along said linear segment so that said nut will slip along the innermost surface of said jaw member to permit said nut to ratchet.

19. A ratchet wrench comprising:

a handle;

a body disposed on said handle, and having a head provided with a main wall defining an opening for receiving an element to be rotated;

a pair of supplementary walls extending radially outwardly from said main wall, each of said supplementary walls being formed of a plurality of variously-shaped segments defining a recess, each of said supplementary walls including a ramp segment having a mouth, and a linear segment opposite said ramp segment;

a pair of element engaging jaw members retained in each of said recesses, each of said jaw members having a multiplicity of variously-shaped surfaces slidable and pivotable along said segments of each of said recesses, each of said jaw members including an innermost surface comprising a single V-shaped notch having flat faces extending from each side thereof, each of said jaw members further including an outermost surface joined to said innermost surface and having a dimpled end portion and a nosed end portion opposite said dimpled end portion, said dimpled end portion being slidable against said ramp segment into and out of said mouth and said nosed end portion being slidable and pivotable against said linear segment; and a pair of springs, each of said springs being mounted separately in each of said recesses for biasing each of said jaw members into said opening, whereby rotation of said wrench in one direction maintains a bias of said spring such that when the element to be rotated is engaged against each of said jaw members, the element is drivingly rotated; and whereby rotation of the wrench in an opposite direction acts against the bias of the spring to move each of said jaw members such that the element to be rotated slips against each of the said jaw members to permit the element to ratchet.

20. The wrench of claim 19, wherein each of said springs is engageable with said nosed end portion to normally force said dimpled end portion into said mouth.

* * * * *